US007265286B1

(12) United States Patent
Lin

(10) Patent No.: US 7,265,286 B1
(45) Date of Patent: Sep. 4, 2007

(54) HARMONICA

(76) Inventor: Hsiu-Hsiung Lin, No. 63, Fu-Hsing St., Hua-Lian City, Hua-Lian Hsien (TW)

( * ) Notice: Subject to any disclaimer, the term of this patent is extended or adjusted under 35 U.S.C. 154(b) by 14 days.

(21) Appl. No.: 11/395,852

(22) Filed: Mar. 30, 2006

(51) Int. Cl.
*G10D 7/12* (2006.01)

(52) U.S. Cl. ..... 84/377

(58) Field of Classification Search ..... 84/377, 84/378, 379, 375, 330
See application file for complete search history.

(56) References Cited

U.S. PATENT DOCUMENTS

2002/0157519 A1* 10/2002 Epping ..... 84/377

* cited by examiner

*Primary Examiner*—Kimberly Lockett
(74) *Attorney, Agent, or Firm*—Ladas & Parry LLP

(57) ABSTRACT

A the harmonica includes a comb having a plurality of cell sets each including four subcells defined by cell walls and airflow partition walls, a plurality of mouthpiece openings disposed upstream or downstream of and registered with the corresponding cell sets in terms of flow of exhaled air or inhaled air, and a reed vibrating member having air passageways registered with the subcells, and a plurality of pairs of reeds registered with the subcells and are vibratile in the corresponding air passageways. When an air flow is evenly introduced into four subcells in one cell set through the corresponding mouth opening as a result of an inhaling or exhaling motion of the player to vibrate the four reeds in the corresponding cell set, four substantially the same notes of diatonic scales are produced.

7 Claims, 3 Drawing Sheets

45

| | 1 | 2 | 3 | 4 | 5 | 6 | 7 | 8 | 9 | 10 | 11 | 12 |
|---|---|---|---|---|---|---|---|---|---|---|---|---|
| 40 | $G_2G_1$ | $D_1D$ | $C_1C$ | $F_1F$ | $E_1E$ | $A_1A$ | $G_1G$ | $B_1B$ | Cc | Dd | Ee | Ff |
| | $G_1G_2$ | $DD_1$ | $CC_1$ | $FF_1$ | $EE_1$ | $AA_1$ | $GG_1$ | $BB_1$ | cC | dD | eE | fF |
| | ↑ | ↓ | ↑ | ↓ | ↑ | ↓ | ↑ | ↓ | ↑ | ↓ | ↑ | ↓ |

45

| 13 | 14 | 15 | 16 | 17 | 18 | 19 | 20 | 21 | 22 | 23 | 24 |
|---|---|---|---|---|---|---|---|---|---|---|---|
| Gg | Aa | $cc^1$ | Bb | $ee^1$ | $dd^1$ | $gg^1$ | $ff^1$ | $c^1c^2$ | $aa^1$ | $e^1e^2$ | $bb^1$ |
| gG | aA | $c^1c$ | bB | $e^1e$ | $d^1d$ | $g^1g$ | $f^1f$ | $c^2c^1$ | $a^1a$ | $e^2e^1$ | $b^1b$ |
| ↑ | ↓ ↑ | ↓ ↑ | ↓ | ↑ ↓ | ↑ ↓ | ↑ | ↓ | | | | |

FIG. 4

45

| | 1 | 2 | 3 | 4 | 5 | 6 | 7 | 8 | 9 | 10 | 11 | 12 |
|---|---|---|---|---|---|---|---|---|---|---|---|---|
| 40 | $G_1G_1$ | DD | CC | FF | EE | AA | GG | BB | cc | dd | ee | ff |
| | $G_1G_1$ | DD | CC | FF | EE | AA | GG | BB | cc | dd | ee | ff |
| | ↑ | ↓ | ↑ | ↓ | ↑ | ↓ | ↑ | ↓ | ↑ | ↓ | ↑ | ↓ |

45

| 13 | 14 | 15 | 16 | 17 | 18 | 19 | 20 | 21 | 22 | 23 | 24 |
|---|---|---|---|---|---|---|---|---|---|---|---|
| gg | aa | $c^1c^1$ | bb | $e^1e^1$ | $d^1d^1$ | $g^1g^1$ | $f^1f^1$ | $c^2c^2$ | $a^1a^1$ | $e^2e^2$ | $b^1b^1$ |
| gg | aa | $c^1c^1$ | bb | $e^1e^1$ | $d^1d^1$ | $g^1g^1$ | $f^1f^1$ | $c^2c^2$ | $a^1a^1$ | $e^2e^2$ | $b^1b^1$ |
| ↑ | ↓ | ↑ | ↓ | ↑ | ↓ | ↑ | ↓ | ↑ | ↓ | ↑ | ↓ |

FIG. 5

HARMONICA

BACKGROUND OF THE INVENTION

1. Field of the Invention

This invention relates to a harmonica, more particularly to a harmonica which has four reeds in each cell set of a comb for tuning four substantially same notes by a player's blowing or drawing action.

2. Description of the Related Art

A conventional 24-holes tremolo harmonica generally has two reeds in each cell of a comb to be tuned to the same note (or one tuned slightly higher than the other) so as to create a vibrating or tremolo effect to provide a timbre like a piano or an accordion. A conventional octave harmonica is similar to the tremolo harmonica in reed layout and musical range, except that two reeds in each cell of a comb are tuned an octave apart from each other so as to result in a stronger and full-bodied sound. The conventional octave harmonica is generally used in a harmonica duet, quartet, or ensemble, and is seldom used for playing a solo.

It is desirable to provide a harmonica that can create a vibrating or tremolo effect, and that can produce a strong and full-bodied sound like what the conventional octave harmonica does.

SUMMARY OF THE INVENTION

The object of the present invention is to provide a harmonica which can create a vibrating or tremolo effect, which can produce a strong and full-bodied sound like what the conventional octave harmonica does, and which has a construction to permit easy playing.

According to this invention, the harmonica includes a comb having a central wall, a plurality of upper cell walls and a plurality of lower cell walls extending upwardly and downwardly from the central wall and displaced from one another in a longitudinal direction so as to define a plurality of upper and lower cells, respectively. Each of the lower cells is registered with the respective upper cell to form a cell set. A plurality of airflow upper partition walls and a plurality of lower partition walls are formed in and divide the upper and lower cells into first and second upper subcells and first and second lower subcells, respectively. A plurality of mouthpiece openings are displaced from one another in the longitudinal direction, and are disposed upstream or downstream of each of corresponding ones of the cell sets in terms of flow of exhaled air or inhaled air, and are registered with the corresponding cell sets. A reed vibrating member has a plurality of upper air passageways and a plurality of lower air passageways disposed downstream or upstream of and registered with the corresponding upper and lower cells, and a plurality of pairs of first and second upper reeds and a plurality of pairs of first and second lower reeds displaced from one another in the longitudinal direction. Each pair of the first and second upper reeds are registered with a corresponding pair of the first and second upper subcells, and are vibratile in the corresponding upper air passageways. Each pair of the first and second lower reeds are registered with a corresponding pair of the first and second lower subcells, and are vibratile in the corresponding lower air passageways. When an air flow is evenly introduced into four subcells in one cell set through the corresponding mouth opening as a result of an inhaling or a exhaling motion to vibrate the four reeds in the corresponding cell set, four substantially the same notes of diatonic scales are respectively produced.

BRIEF DESCRIPTION OF THE DRAWINGS

Other features and advantages of the present invention will become apparent in the following detailed description of the preferred embodiments of the invention, with reference to the accompanying drawings, in which:

FIG. 4 is a schematic representation of the tones that can be played using the preferred embodiment; and FIG. 5 is a schematic representation of the tones that can be played using an alternative embodiment of a harmonica according to this invention.

DETAILED DESCRIPTION OF THE PREFERRED EMBODIMENTS

Figure 1:
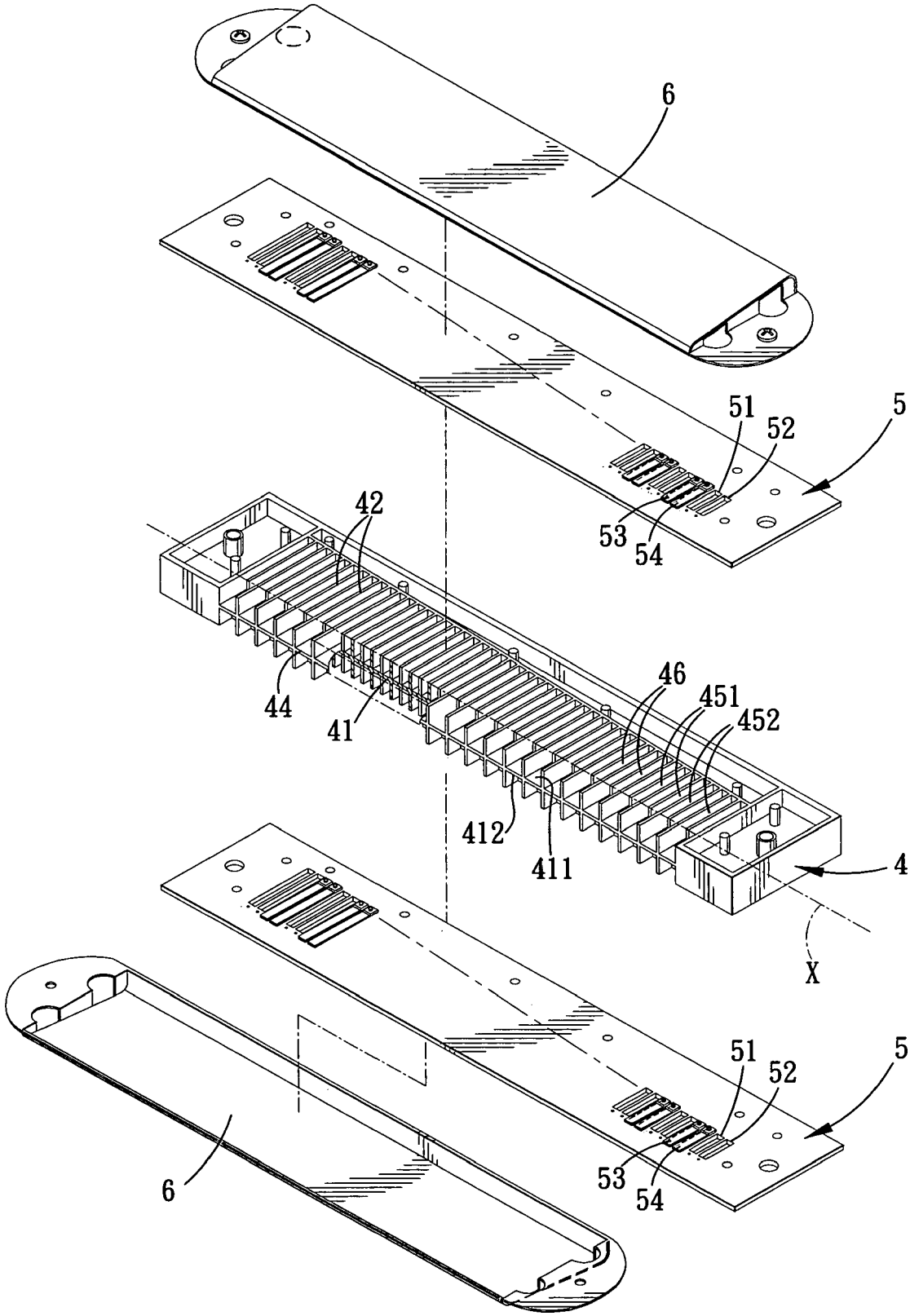
FIG. 1 is an exploded perspective view of the preferred embodiment of a harmonica according to this invention.
Figure 2:
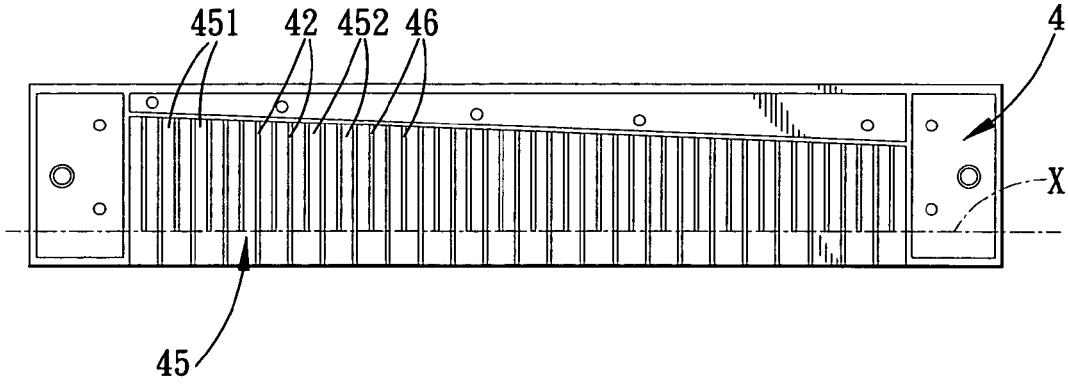
FIG. 2 is a schematic top view of the preferred embodiment, showing the relationship between mouthpiece openings and cell sets.
Figure 3:
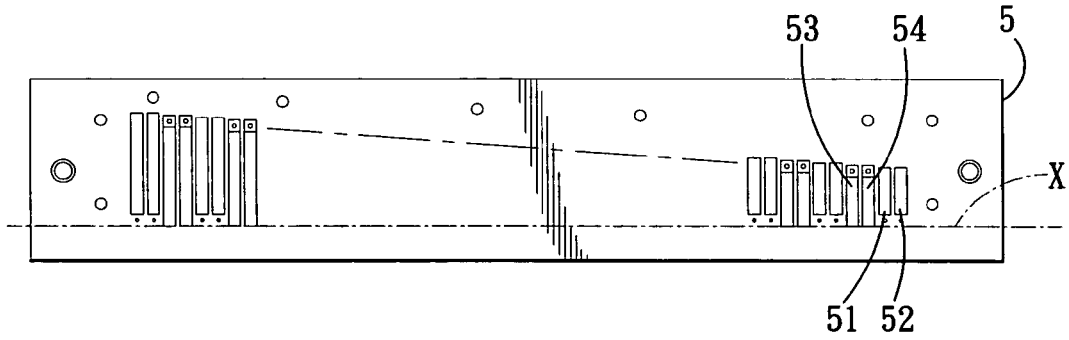
FIG. 3 is a schematic top view of the preferred embodiment, showing alternately arranged first and second reeds.

Referring to FIGS. 1 to 4, the preferred embodiment of a harmonica according to the present invention is shown to comprise a comb 4, a plurality of mouthpiece openings 44, a reed vibrating member, and upper and lower covers 6.

The comb 4 has a wedge-shaped central wall 41 with upper and lower wall surfaces 411,412, a plurality of upper cell walls 42 which extend upwardly from the upper wall surface 411 and which are displaced from one another in a longitudinal direction (X) so as to define a plurality of upper cells 45, and a plurality of lower cell walls 42 which extend downwardly from the lower wall surface 412 and which are displaced from one another in the longitudinal direction (X) so as to define a plurality of lower cells 45. Each of the lower cells 45 is registered with a respective one of the upper cells 45 to form a cell set 40. The comb 4 further has a plurality of airflow upper partition walls 46, each of which is formed in and divides a respective one of the upper cells 45 into first and second upper subcells 451,452, and a plurality of airflow lower partition walls 46, each of which is formed in and divides a respective one of the lower cells 45 into first and second lower subcells 451,452.

The mouthpiece openings 44 are displaced from one another in the longitudinal direction (X), and are integrally formed with the comb 4 in this embodiment. Specifically, the upper and lower cell walls 42 respectively extend in a first transverse direction relative to the longitudinal direction (X) and beyond the airflow upper and lower partition walls 46 so as to confine the mouthpiece openings 44. Thus, each of the mouthpiece openings 44 is disposed upstream or downstream of a corresponding one of the cell sets 40 in terms of flow of exhaled air or inhaled air, and is registered with the corresponding one of the cell sets 40 in the first transverse direction.

The reed vibrating member includes upper and lower reed vibrating plates 5 disposed above and under the comb 4, respectively. Each of the upper and lower vibrating plates 5 has a plurality of first air holes 51 and a plurality of second air holes 52. The first and second air holes 51,52 are arranged alternately in the longitudinal direction (X). Specifically, the first and second air holes 51,52 in each pair are registered with the first and second upper (lower) subcells 451,452 of the corresponding pair to serve as upper (lower) air passageways 51,52. Thus, the upper and lower air passageways 51,52 are disposed downstream or upstream of the corresponding upper and lower cells 45 in a second transverse direction relative to both the longitudinal direction (X) and the first transverse direction, and are registered with the corresponding upper and lower cells 45.

The reed vibrating member further includes a plurality of pairs of first and second upper reeds 53,54 and a plurality of pairs of first and second lower reeds 53,54 displaced from one another in the longitudinal direction (X), respectively. The first and second upper reeds 53,54 are alternate to one another. The first and second lower reeds 53,54 are alternate to one another. The first and second upper reeds 53,54 in each pair are registered with the first and second upper subcells 451,452 of the corresponding upper cell 45, and are vibratile in the corresponding upper air passageways 51,52. The first and second lower reeds 53,54 in each pair are registered with the first and second lower subcells 451,452 of the corresponding lower cell 45, and are vibratile in the corresponding lower air passageways 51,52. Specifically, each of the reeds 53,54 has an end which is pivotally mounted on the respective one of the upper and lower reed vibrating plates 5 proximate to the corresponding one of the first and second air holes 51,52, and an opposite end which is vibratile relative to the corresponding one of the first and second air holes 51,52.

The upper and lower covers 6 are disposed above and below the upper and lower reed vibrating plates 5, respectively, so as to protect the reed vibrating member and to act as a resonator for the reeds 53,54.

When an air flow is evenly introduced into the first and second upper subcells 451,452 and the first and second lower subcells 451,452 from the corresponding mouth opening 44 as a result of an inhaling or exhaling motion of a player to vibrate the first and second upper reeds 53,54 and the first and second lower reeds 53,54 in the corresponding cell set 40, four substantially the same notes of diatonic scales are respectively produced. Referring to FIG. 4, in this embodiment, each pair of the first and second upper reeds 53,54 and each pair of the first and second lower reeds 53,54 are tuned apart from each other by an octave so as to be tuned to the tones of an octave. As the harmonica of this invention is similar to the conventional 24-holes tremolo harmonica in shape and the manner of playing, such as the blowing and drawing sequences and the number of mouthpiece openings 44, playing of the harmonica of this invention is relatively easy. The reeds 53,54 in each cell 45 are configured to be tuned to tones of an octave, such as a note of a lower C (indicated as C) and a middle C (indicated as c). In addition, the first upper and lower reeds 53 or the second upper and lower reeds 54 in each cell set 40 are configured to be tuned to tones of an octave, such as a note of a middle C (indicated as c) and a higher C (indicated as $c^1$). Thus, four tones of an octave can be generated for each inhaling or exhaling action of the player to result in a strong, sonorous and powerful sound effect. In FIG. 4, the superscript number indicates that the tone is a higher octave, and the subscript number indicates that the tone is a lower octave. The arrow (↑) indicates an exhaling action, and the arrow (↓) indicates an inhaling action.

Referring to FIG. 5, in an alternative embodiment of this invention, the first and second upper and lower reeds 53,54 for each of the cell sets 40 are tuned to the same note, or one tuned slightly higher than the other so as to create an enhanced vibrating or tremolo effect for simulating the timbre of an accordion. Of course, the first and second upper reeds 53,54 for each of the cell sets 40 may be tuned to the same note, and to an octave apart from the respective first and second lower reeds 53,54 for the corresponding cell set 40.

With such a construction, the harmonica of the present invention is configured similar to the conventional 24-holes tremolo harmonica to be easily played, and can generate a strong, sonorous and powerful effect. Moreover, by virtue of the airflow partition walls 46, the airflow as a result of an inhale or exhale action by a player can be introduced into the subcells 451,452 more evenly.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A harmonica comprising:

a comb having a central wall with upper and lower wall surfaces, a plurality of upper cell walls which extend upwardly from said upper wall surface and which are displaced from one another in a longitudinal direction so as to define a plurality of upper cells, a plurality of lower cell walls which extend downwardly from said lower wall surface and which are displaced from one another in the longitudinal direction so as to define a plurality of lower cells, each of said lower cells being registered with a respective one of said upper cells to form a cell set, a plurality of airflow upper partition walls, each of which is formed in and divides a respective one of said upper cells into first and second upper subcells, and a plurality of airflow lower partition walls, each of which is formed in and divides a respective one of said lower cells into first and second lower subcells, a plurality of mouthpiece openings displaced from one another in the longitudinal direction, each of said mouthpiece openings being disposed upstream or downstream of a corresponding one of said cell sets in terms of flow of exhaled air or inhaled air, and being registered with the corresponding one of said cell sets in a first transverse direction relative to the longitudinal direction; and a reed vibrating member which has a plurality of upper air passageways, each of which is disposed downstream or upstream of and is registered with a corresponding one of said upper cells in a second transverse direction relative to both the longitudinal direction and the first transverse direction, a plurality of lower air passageways, each of which is disposed downstream or upstream of and is registered with a corresponding one of said lower cells in the second transverse direction, a plurality of pairs of first and second upper reeds which are displaced from one another in the longitudinal direction, said first and second upper reeds being alternate to each other, said first and second upper reeds in each of said pairs being registered with said first and second upper subcells of the corresponding one of said upper cells, and being vibratile in a corresponding one of said upper air passageways, and a plurality of pairs of first and second lower reeds which are displaced from one another in the longitudinal direction, said first and second lower reeds being alternate to each other, said first and second lower reeds in each of said pairs being registered with said first and second lower subcells of the corresponding one of said lower cells, and being vibratile in a corresponding one of said lower air passageways, whereby when an air flow is evenly introduced into said first and second upper subcells and said first and second lower subcells from a corresponding one of said mouth openings as a result of an inhaling or exhaling motion to vibrate said first and second upper reeds and said first and second lower reeds in a corresponding one of said cell sets, four substantially the same notes of diatonic scales are respectively produced.

2. The harmonica of claim 1, wherein said first and second upper reeds in each pair or said first and second lower reeds in each pair are tuned apart from each other by an octave.

3. The harmonica of claim 1, wherein said first upper reed in each pair is tuned apart from said first lower reed in a corresponding pair by an octave, and said second upper reed in each pair is tuned apart from said second lower reed in a corresponding pair by an octave.

4. The harmonica of claim 1, wherein said first and second upper reeds in each pair are tuned to the same note as said first and second lower reeds in a corresponding pair.

5. The harmonica of claim 1, wherein said mouthpiece openings are integrally formed with said comb.

6. The harmonica of claim 1, wherein said reed vibrating member includes upper and lower reed vibrating plates disposed above and under said comb, respectively, each of said upper and lower vibrating plates having a plurality of first air holes and a plurality of second air holes, said first air holes and said second air holes being displaced alternately from each other in the longitudinal direction, said first and second air holes of each pair in said upper reed vibrating plate being registered with said first and second upper subcells in a corresponding pair to serve as one of said upper air passageways, said first and second air holes of each pair in said lower reed vibrating plate being registered with said first and second lower subcells in a corresponding pair to serve as one of said lower air passageways, each of said reeds having an end which is pivotally mounted on a respective one of said upper and lower reed vibrating plates proximate to a respective one of said first and second air holes, and an opposite end which is vibratile relative to the respective one of said first and second air holes.

7. The harmonica of claim 6, further comprising upper and lower covers disposed above and below said upper and lower reed vibrating plates, respectively, so as to protect said reed vibrating member and to act as a resonator for said first and second upper reeds and said first and second lower reeds.

* * * * *